US007269865B2

(12) United States Patent
James et al.

(10) Patent No.: US 7,269,865 B2
(45) Date of Patent: Sep. 18, 2007

(54) SOFA WITH FLIP-UP SPRING DECK

(75) Inventors: H. Keith James, Carl Junction, MO (US); Dennis E. Arft, Joplin, MO (US)

(73) Assignee: L & P Property Management Company, South Gate, CA (US)

( * ) Notice: Subject to any disclaimer, the term of this patent is extended or adjusted under 35 U.S.C. 154(b) by 183 days.

(21) Appl. No.: 11/172,152

(22) Filed: Jun. 30, 2005

(65) Prior Publication Data

US 2007/0000047 A1 Jan. 4, 2007

(51) Int. Cl.
*A47C 17/04* (2006.01)
*A47C 17/22* (2006.01)

(52) U.S. Cl. ..... 5/58; 5/186.1; 5/191; 5/12.1

(58) Field of Classification Search ..... 5/58, 5/24, 25, 26.1, 37.1, 27, 191, 186.1, 308, 5/12.1

See application file for complete search history.

(56) References Cited

U.S. PATENT DOCUMENTS 984,685 A 2/1911 Luppino
1,032,063 A * 7/1912 Hoey ..... 5/44.1
1,244,821 A 10/1917 Zaleski et al.
1,398,324 A 11/1921 Hosner
1,455,215 A * 5/1923 Levin ..... 5/18.1
1,751,897 A 3/1930 Thum
1,824,156 A 9/1931 Kimble
2,033,795 A 3/1936 Ward, Jr.
2,692,009 A * 10/1954 Warshaver ..... 5/58
4,538,308 A 9/1985 Grigoriev
5,129,113 A 7/1992 Sherman
5,329,654 A 7/1994 Sherman
5,794,283 A 8/1998 Vila et al.
6,050,638 A * 4/2000 West, III ..... 297/219.1

* cited by examiner

*Primary Examiner*—Alexander Grosz
(74) *Attorney, Agent, or Firm*—Shook, Hardy & Bacon, L.L.P.

(57) ABSTRACT

This invention is directed to a sofa with a flip-up deck. The sofa has a sofa frame with a back, a front, and a pair of opposed arms. The deck is rotatably coupled between the pair of opposed arms at a position intermediate the front and the back. Further, the deck is adapted to move between a closed position and an open position.

6 Claims, 7 Drawing Sheets

SOFA WITH FLIP-UP SPRING DECK

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

This invention relates generally to a sofa, and, more particularly, to a sofa with a flip-up deck that conceals a cavity.

Traditional sofas are known in the art and designed to support a user in a seated position. The sofa generally contains a fixed deck or support surface for supporting the user. The deck extends between the two sides and the front and back of the sofa. The cushions are placed on top of the support deck to provide a comfortable form and fit for the user. However, the deck of the traditional sofa is generally fixed and provides for wasted space within the sofa unit.

It would be desirable to manufacture a sofa with a deck that provides support to the user when seated. Further, it would be desirable to manufacture a sofa with a deck that is rotatable about a position intermediate the front and rear of the sofa. Still further, it would be desirable to manufacture a sofa with a deck that is upwardly rotatable to reveal a cavity. Still further, it would be desirable to manufacture a sofa with a rotatable deck positioned at an intermediate position for sufficient clearance with respect to the back of the sofa.

Thus, while sofas with fixed decks are known, there remains a need for an improved sofa with a flip-up deck that is hinged at an intermediate position that provides the same form, fit, and construction of a traditional sofa with a fixed deck.

BRIEF SUMMARY OF THE INVENTION

This invention is directed to a sofa with a spring deck. The sofa is constructed with a sofa frame, which includes a pair of arms, a back, a front, and a spring deck. The spring deck is designed to provide support when the unit is used as a sofa. The spring deck is movable from a closed position to an open position to reveal a cavity within the sofa unit. The spring deck consists of a frame, a rod, and a support surface. The frame is mounted to the sofa. Specifically, the frame is attached to the arms of the sofa at a location intermediate the front and rear of the sofa. The rod is disposed horizontally between the frame. The frame extends forwardly along both sides and across the front and back of the sofa.

The spring deck further includes a plurality of webbings and a cover. The webbings extend from a front portion of the frame to a back portion of the frame. As stated above, the rod is coupled to the frame at a location intermediate to the front and rear of the sofa. The webbings are attached to the front portion of the frame and the back portion of the frame. The webbings further contain sinuous wires that encircle each webbing in a serpentine-like manner. The wires extend from the portion of the webbing where the rod is located to the front portion of the frame thereby creating a hinge at the intermediate position and defining the support surface. Thus, the support surface extends forwardly from the rod to the front portion of the frame.

In another embodiment of the present invention, the spring deck includes a frame and a support surface. The frame is mounted to the sofa by a pair of channel mounts. The frame is slidably and rotatably coupled to the channel mounts by a pair of rollers. The spring deck also contains a cover and a plurality of webbings. The webbings extend from a rear portion of the frame to a front portion of the frame thereby defining the support surface.

In yet another embodiment the spring deck includes a frame and a support surface. The frame is mounted to the sofa by a mounting rod. Specifically, the frame is rotatably coupled to the mounting rod. The mounting rod is located at an intermediate location on the arms of the sofa. The frame extends forwardly from the intermediate location of the mounting rod to the front portion of the sofa. The spring deck also contains a cover and a plurality of webbings. The webbings extend from the mounting rod to a front portion of the frame thereby defining the support surface.

BRIEF DESCRIPTION OF THE SEVERAL VIEWS OF THE DRAWING

These and other objectives and advantages of the present invention will be more readily apparent from the following detailed description of the drawings of the preferred embodiment of the invention that are herein incorporated by reference and in which.

DETAILED DESCRIPTION OF THE INVENTION

Figure 1:
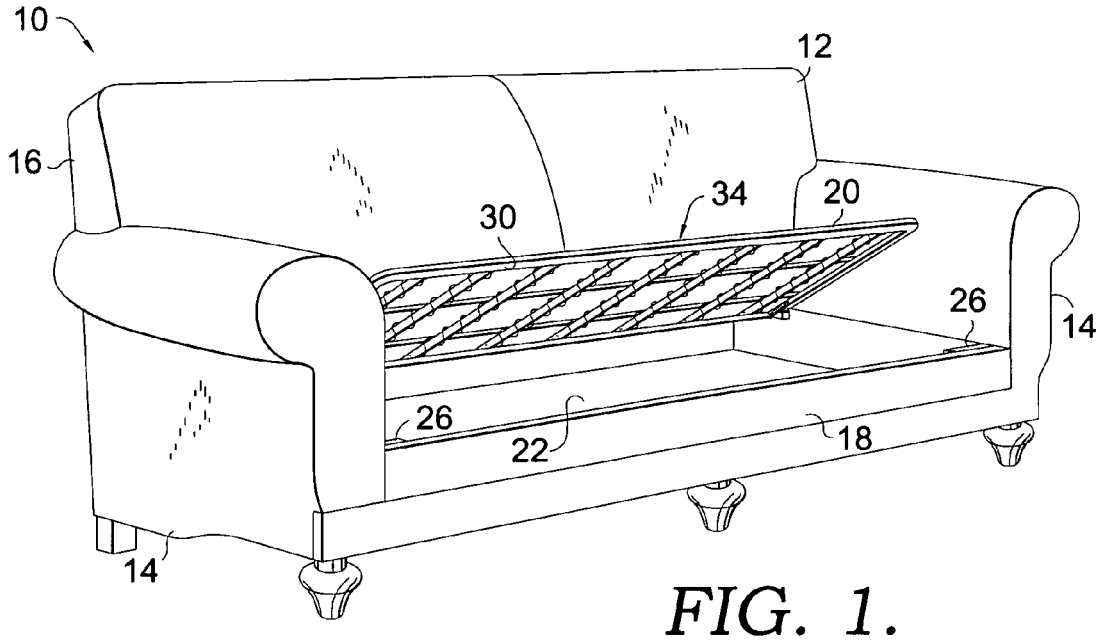
FIG. 1 is a perspective view of a sofa according to the present invention, with a spring deck in an open position.
Figure 2:
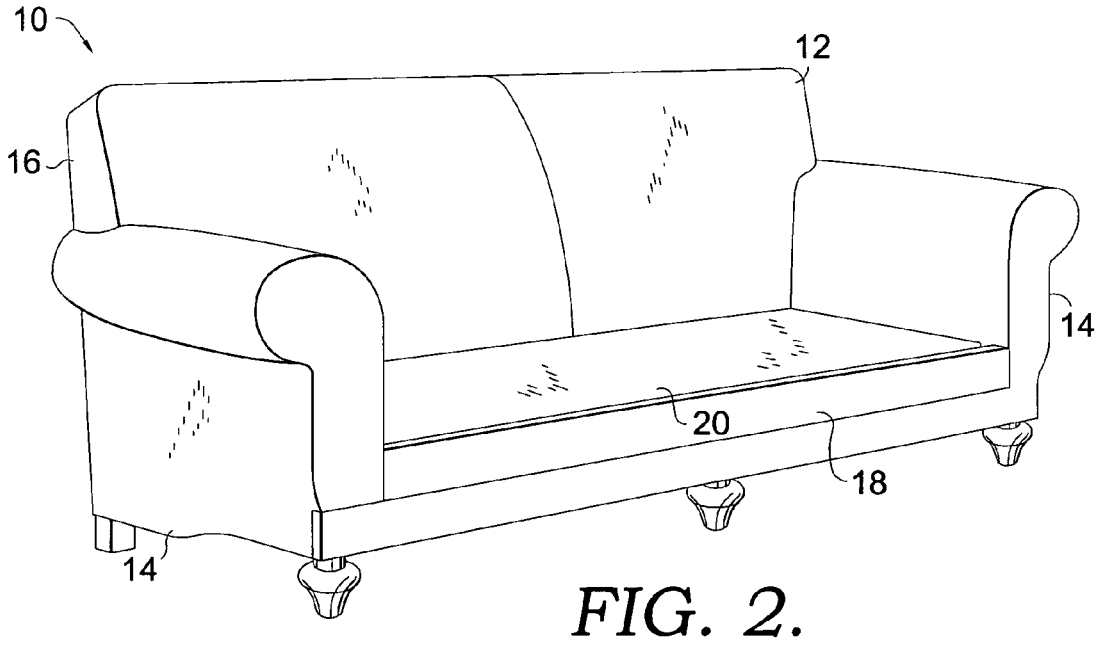
FIG. 2 is view similar to FIG. 1, but with the spring deck in a closed position.
Figure 4:
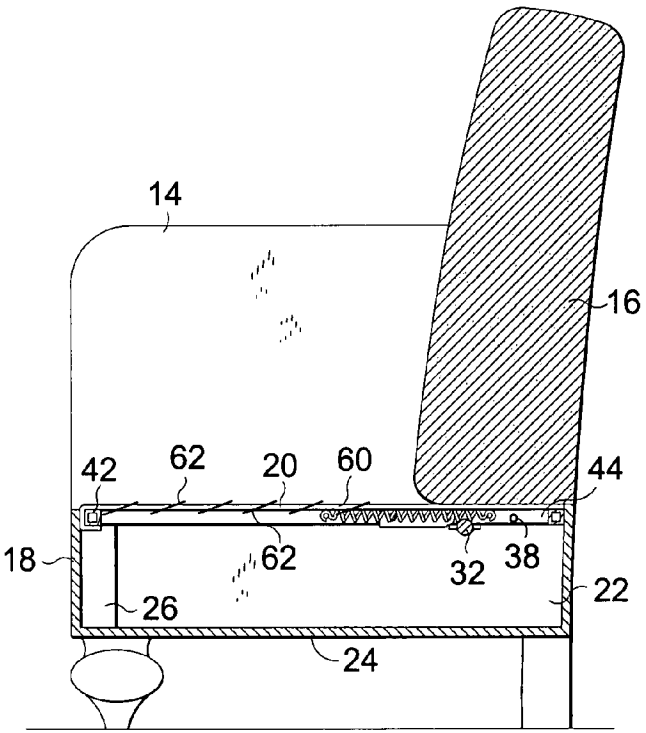
FIG. 4 is a side cross-sectional view of the sofa of FIG. 2.

With initial reference to FIGS. 1 and 2, a sofa according to the principles of the present invention is designated generally with the reference numeral 10. Throughout this specification, the term sofa is also intended to encompass love seats and other smaller units. The sofa 10 is constructed with a sofa frame 12, which includes a pair of arms 14, a back 16, a front 18, and a spring deck 20. FIG. 1 shows the spring deck 20 in an open position while FIGS. 2 and 4 show the spring deck 20 in a closed position. The spring deck 20 provides support for the cushions and, thus, the seated user, not shown. As best seen in FIG. 1 and as further described below, the spring deck 20 rotates upwardly to disclose a cavity 22. Referring now to FIGS. 1 and 4, the cavity 22 includes a floor 24 and is formed in an interior area between the arms 14, the back 16, and the front 18. The cavity 22 also contains a pair of stops 26 located proximate each arm 14 and abutting the front 18 of the sofa. The cavity 22 may be used for storage of various items, such as an inflatable mattress, not shown.

Figure 3:
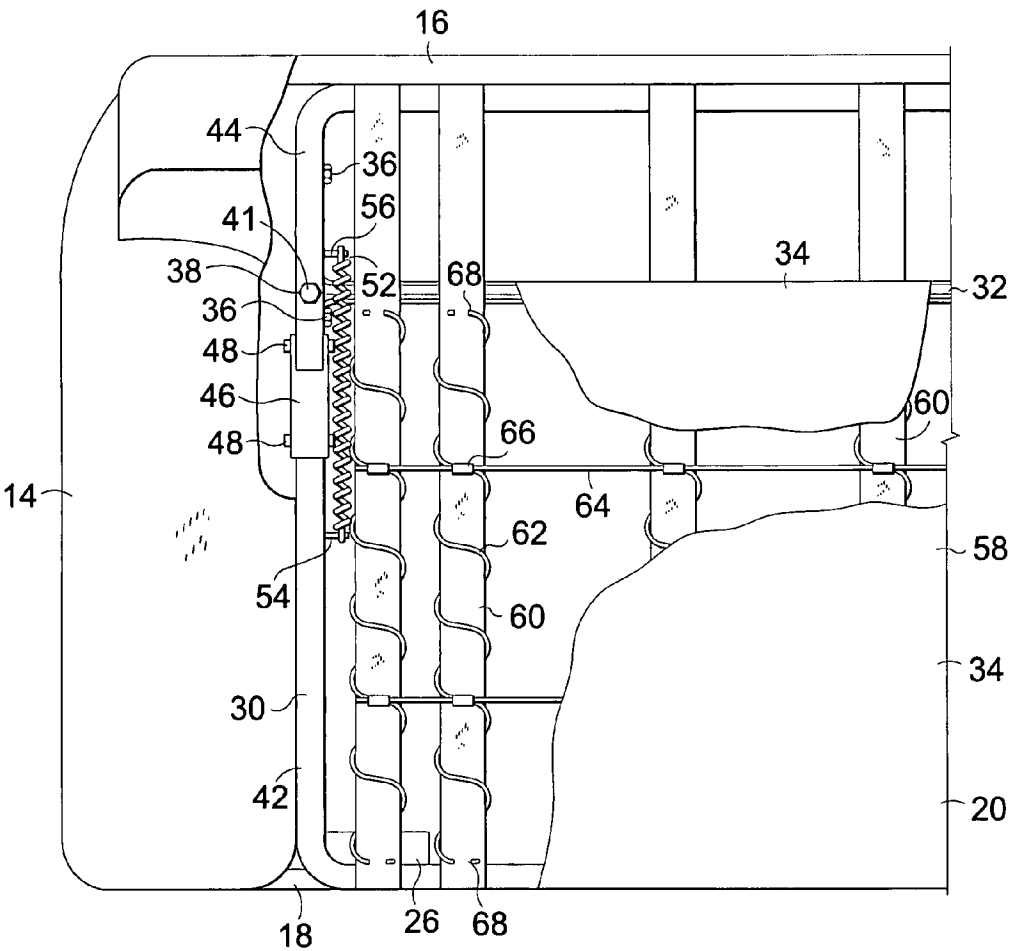
FIG. 3 is a partial top view of the sofa of FIG. 1 with parts broken away to show details of construction.
Figure 5:
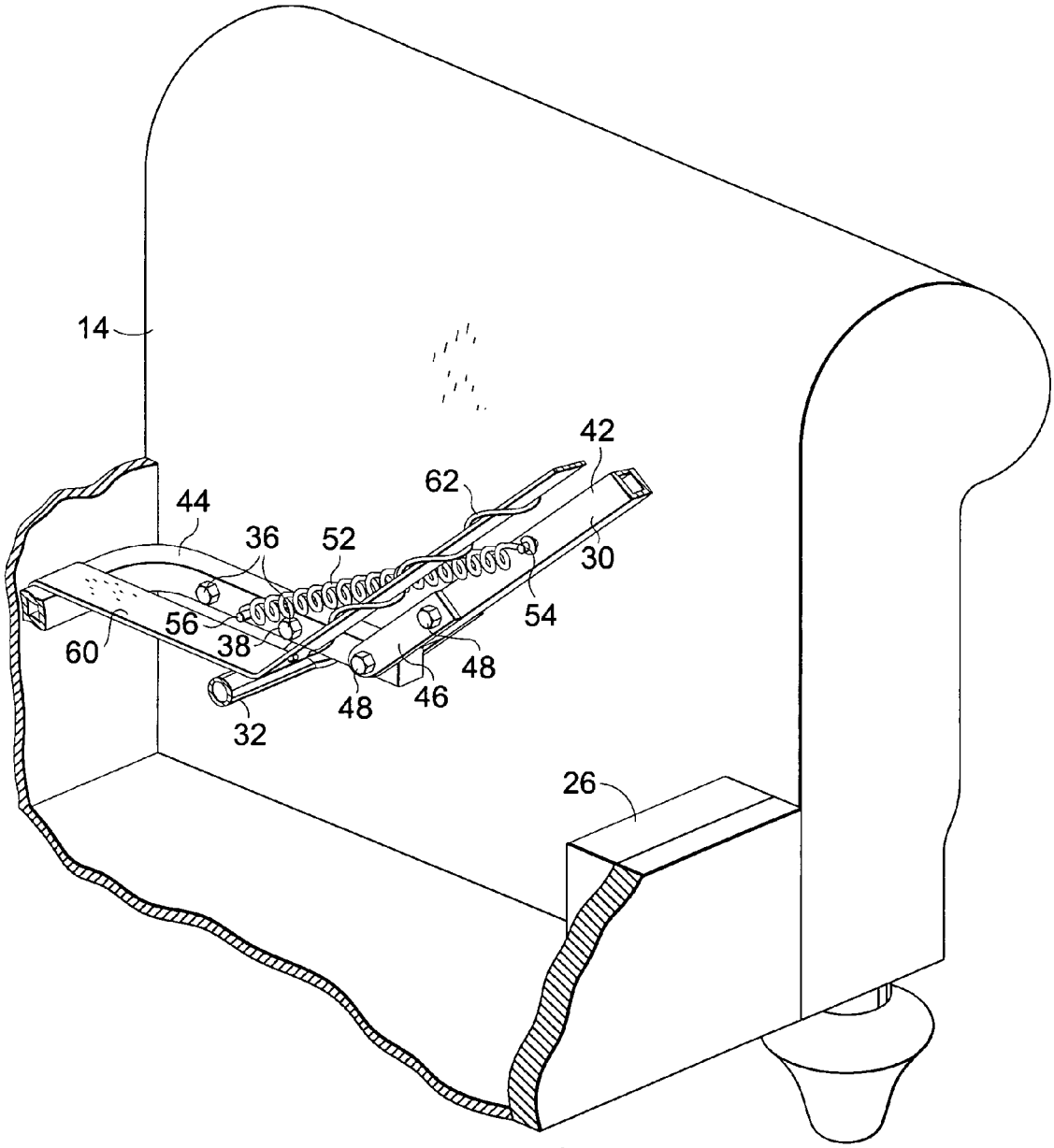
FIG. 5 is a partial enlarged view of portions of the spring deck and frame mounts of the sofa of FIG. 1.

Referring now to FIGS. 3 and 5, the spring deck 20 will be discussed. The spring deck 20 includes a frame 30, a rod 32, and a support surface 34. The spring deck 20 is mounted to the sofa 10 by a pair of apertures 36. Specifically, the spring deck 20 has a number of apertures 36, shown as attachments, formed therein for facilitating attachment to the arms 14. As such the spring deck 20 is fixably coupled to each arm 14. It will be appreciated by one of ordinary skill in the art that any attachment method could be used, such as bolts, screws, nails, or the like. The spring deck 20 further contains a pair of apertures 38, shown as attachments, formed therein for facilitating attachment to the rod 32. The rod 32 contains a pair of apertures 40, not shown, that mate with the holes 38 located on the spring deck. The rod 32 extends between the frame 30 of the spring deck 20 and is fixably coupled thereto. Coupling is achieved via a pair of bolts 41. It will be appreciated by one of ordinary skill in the art that any attachment method could be used, such as screws, nails, welding, or the like. The rod 32 is coupled to the frame 30 at a position intermediate the front 18 and back 16 of the sofa 10. As shown in FIG. 4, the coupling of the rod 32 at the intermediate position serves to provide clearance between the spring deck 20 and the back 16. Thus, the spring deck 20 can be moved from the closed to the open position without interference with the back 16.

Referring now to FIGS. 1, 3, and 5 the frame 30 will be discussed. The frame 30 is constructed from steel tubing and is shaped as shown. It will be appreciated by one of ordinary skill in the art that any suitable material may be used. The frame 30 includes a front portion 42 and a rear portion 44. The rear portion 44 of the frame 20 is fixably coupled to the arms via the apertures 36. The front and rear portions 42, 44 are connected with a bracket 46. Specifically, the front portion 42 of the frame 20 is rotatably coupled to the rear portion 44 of the frame 30 by the bracket 46. The bracket 46 is shaped as shown and contains a number of apertures 48, shown as connections, to facilitate the coupling of the front and rear portions 42, 44 of the frame 30. The apertures 48 align with apertures in each frame member 42, 44, not shown, to attach the front portion 42 to the rear portion 44. The frame 30 extends along the arms 14 and the front 18 and rear 16 of the sofa 10. As seen in FIGS. 3 and 4, the front portion 42 of the frame 30 rests on the stops 26 when the spring deck 20 is in the closed position. Further as seen in FIGS. 3 and 5, a spring 52 is attached to the front and rear portions 42, 44 of the frame 30. The spring 52 is attached by protrusions 54, 56 that extend outwardly from the front and rear portions 42, 44 respectively. The spring 52 facilitates movement of the spring deck 20 from the closed position of FIG. 4 to the open position of FIG. 1.

Referring now to FIGS. 3 and 4, the spring deck 20 also contains a cover 58 and a plurality of webbings 60. The webbings 60 extend from the rear portion 44 to the front portion 42 of the frame 30. As stated above, the rod 32 is coupled between the arms 14 of the sofa 10 via the frame 30 at a position intermediate the front 18 and back 16 of the sofa 10. The webbings 60 are attached to the front and rear portions 42, 44 of the frame 30. It will be appreciated by one of ordinary skill in the art that any attachment method may be used.

As stated above, the webbings 60 of the support surface 34 extend from the rear portion 44 to the front protion 42 of the frame 30. The webbings 60 of the support surface 34 further include sinuous wires 62 that encircle each webbing 60 in a serpentine-like manner. The webbings 60 are interconnected by a number of support rods 64. The support rods 64 extend between the sides 44 of the frame 30 and attach to the webbings 60 via couplers 66. The rods 64 together with the couplers 66 serve to align the webbings 60 of the support surface 34 to provide a smooth, uniform support surface 34 when combined with the cover 58. The sinuous wires 62 are connected to the webbings 60 via slits 68. As best seen in FIG. 5, the location of the sinuous wires 62 on the webbings 60 creates a hinge at the intermediate position proximate the location of the rod 32 to provide the support surface 34 of the spring deck 20. As stated above the hinge at the intermediate position serves to allow for clearance between the spring deck 20 and the back 16 of the sofa 10. The support surface 34 is defined by the webbings 60 with the sinuous wires 62 extending from the rod 32 toward the front portion 42 of the frame 30 and the cover 58. The cover 58 extends along the frame 30 and is fixably coupled thereto.

Referring to FIGS. 1-3, the operation of the sofa 10 will now be discussed. FIG. 1 illustrates the sofa 10 in the open position with the spring deck 20 flipped up to reveal the cavity 22. FIGS. 2-4 illustrate the sofa 10 in the closed position where the spring deck 20 is oriented generally horizontal for support of the user. In order to move the spring deck 20 from the closed position to the open position, the user simply lifts upwardly on the front portion 42 of the frame 30. The upward lifting by the user causes the front portion 42 of the frame 30 to rotate about the bracket 46 connection between the front portion 42 and rear portion 44 of the frame 30. The intermediate location of the bracket 46 connection between the front portion 42 and rear portion 44 allows the spring deck 20 to be lifted without interfering with the back 16.

Figure 6:
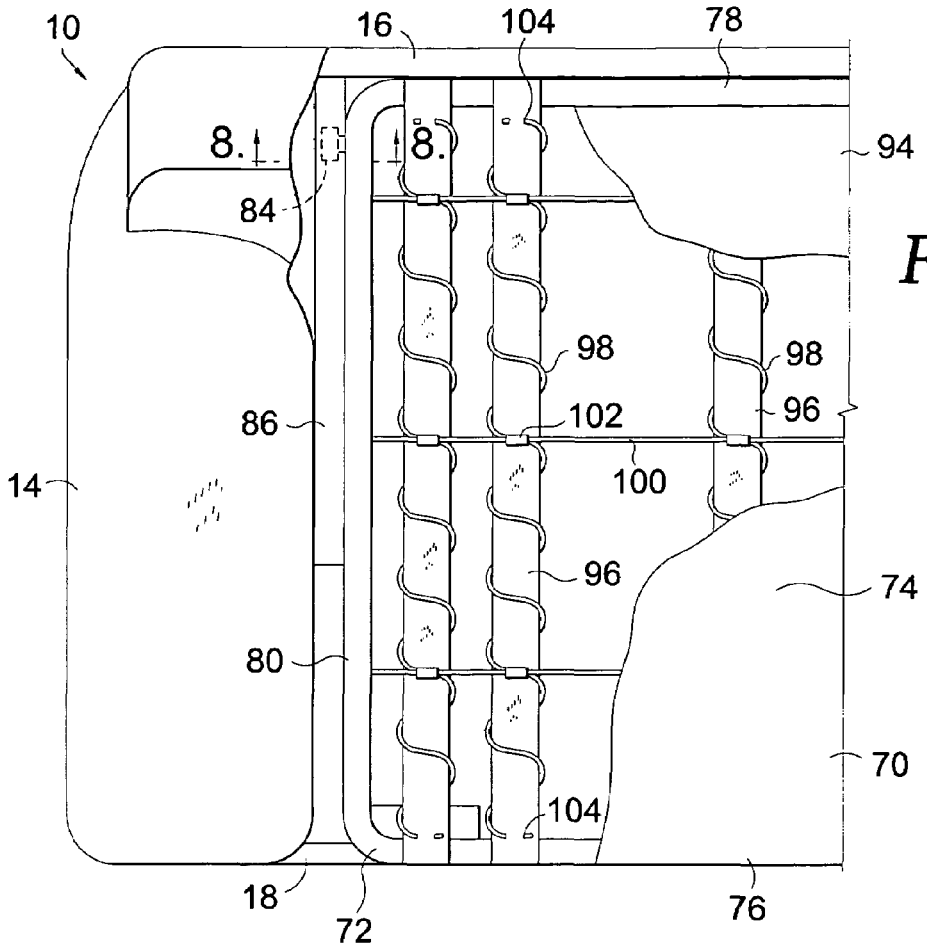
FIG. 6 is a partial top view of an additional embodiment of the spring deck of the sofa of FIG. 1 with parts broken away to show details of construction.
Figure 7:
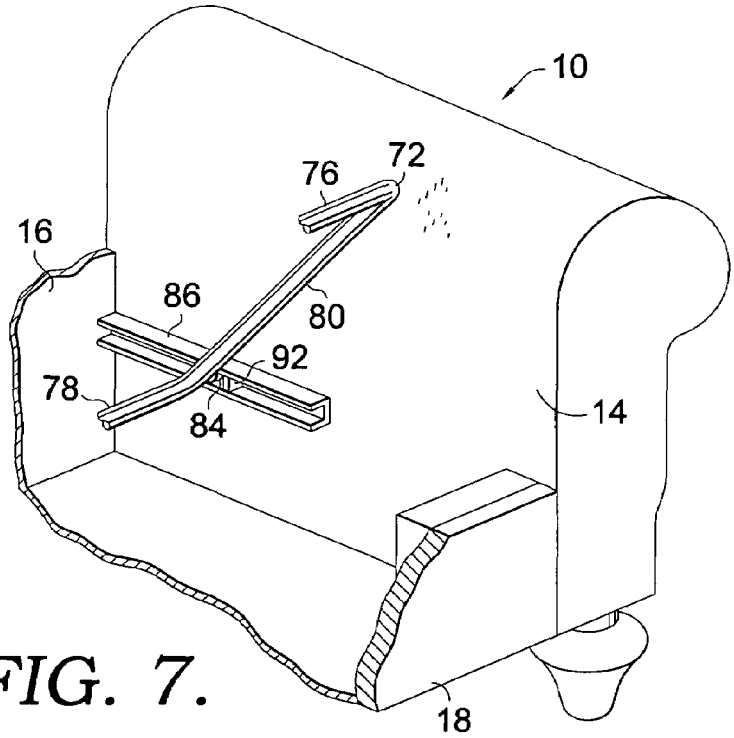
FIG. 7 is a partial enlarged view of portions of the spring deck and channel mounts of the additional embodiment of FIG. 6.
Figure 8:
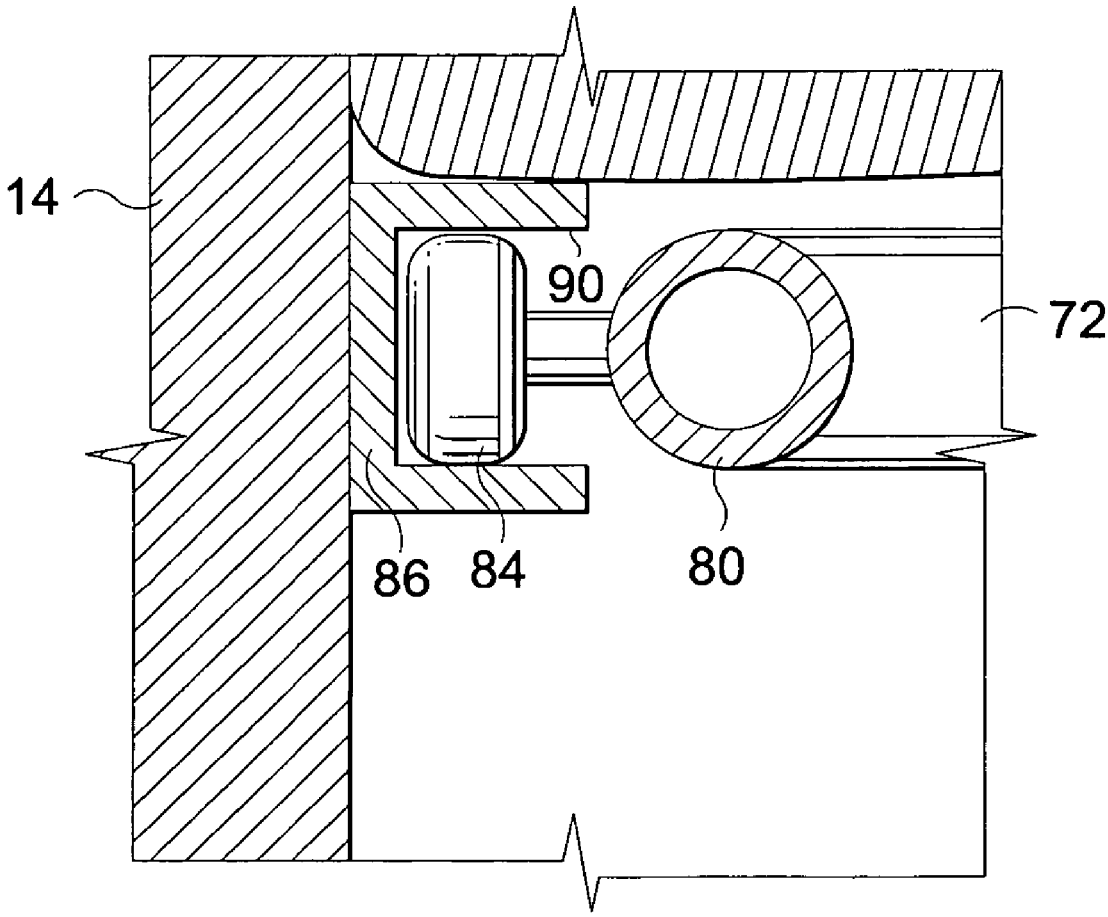
FIG. 8 is a partial enlarged, front plan view of the channel mount and roller attached to the frame.

Referring now to FIGS. 6-8, an additional embodiment of a spring deck 70 will be discussed. It is understood that the additional embodiment of the spring deck 70 works with the components of the sofa 10 described above. The spring deck 70 includes a frame 72 and a support surface 74. The frame 72 is constructed from steel tubing and is generally rectangular. It will be appreciated by one of ordinary skill in the art that any suitable material may be used. The frame 72 includes a front portion 76, a rear portion 78, and a pair of side portions 80. The front 76, rear 78, and side portions 80 may be integral or separate pieces fastened together. The side portions 80 extend from the rear 16 to the front 18 of the sofa 10. Each side portion 80 contains an aperture 82, not shown, located proximate the rear portion 78 with a roller 84 coupled thereto and extending therefrom.

Referring again to FIGS. 6 and 7, the spring deck 70 is mounted to the sofa 10 by a pair of channel mounts 86. The channel mounts 86 have a number of apertures 88, not shown, formed therein for facilitating attachment to the arms 14. As seen in FIGS. 7 and 8, the channel mounts 86 extend from the back 16 of the sofa 10 to an intermediate position. The channel mounts 86 have a C-shaped cross-section 90 that extends along the length of the channel mounts 86 and a stop 92 located at the intermediate position. The C-shaped cross-section 90 is suitable for receipt of the rollers 84 on the side portions 80 of the frame 72. As such, the frame 72 is slidably and rotatably coupled to the C-shaped cross-section 90 of the channel mounts 86 by the pair of rollers 84.

Referring now to FIG. 6, the spring deck 70 also includes a cover 94 and a plurality of webbings 96. The webbings 96 extend from the rear portion 78 to the front portion 76 of the frame 72 and are attached thereto. It will be appreciated by one of ordinary skill in the art that any attachment method may be used. The webbings 96 of the spring deck 70 further include sinuous wires 98 that encircle each webbing 96 in a serpentine manner. The webbings 96 are interconnected by a number of support rods 100. The support rods 100 extend between the sides of the frame 72 and attach to the webbings 96 via couplers 102. The sinuous wires 98 are connected to the webbings 96 via slits 104. The rods 100 together with the couplers 102 serve to align the webbings 96 of the spring deck 70 to provide the smooth, uniform support surface 74. Thus, the support surface 74 is defined by the webbings 96 extending from the rear portion 78 to the front portion 76 of the frame 72 and the cover 94.

Referring now to FIGS. 6 and 7, the operation of the spring deck 70 will be discussed. In order to move the spring deck 70 from the closed position to the open position, the user simply lifts upwardly on the front 76 of the frame 72. The upward lifting by the user causes the front portion 76 of the frame 72 to rotate about the rotatable and slidable connection between the frame 72 and the channel mounts 86. The user then applies a forward pulling force on the front portion 76 of the frame 72. The pulling force causes the rollers 84 to move forwardly within the channel mounts 86. As the rollers 84 move forwardly in the channel mounts 86, the rear 78 of the frame 72 nears the stop 92 located proximate the intermediate position, whereby the user may continue lifting upwardly as the frame 72 now clears the back 16 of the sofa 10. Thus, the rotatable and slidable connection between the rear 78 of the frame 72 and the channel mount 86 allows the spring deck 70 to be lifted without interfering with the back 16.

Figure 9:
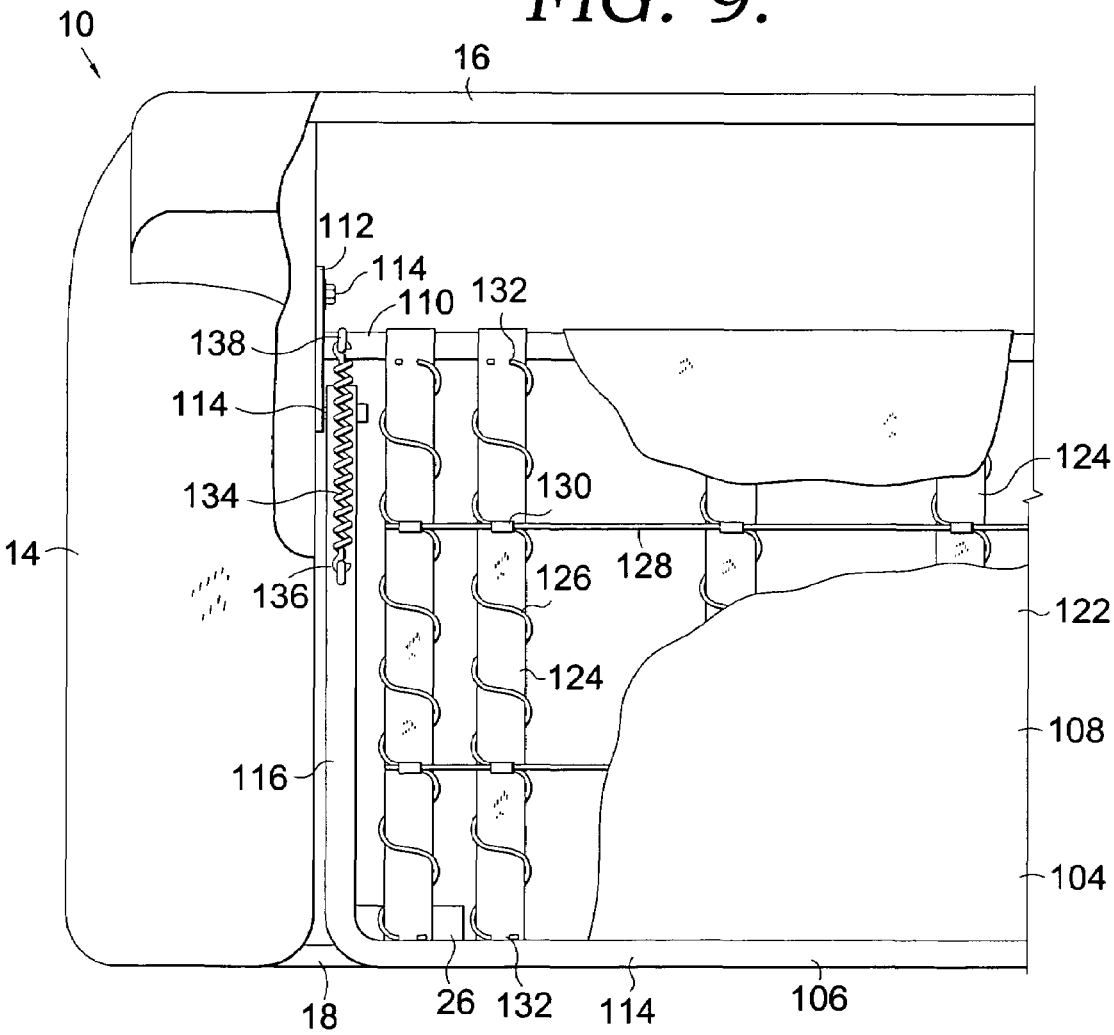
FIG. 9 is a partial top view of an additional embodiment of the spring deck of the sofa of FIG. 1 with parts broken away to show details of construction.
Figure 10:
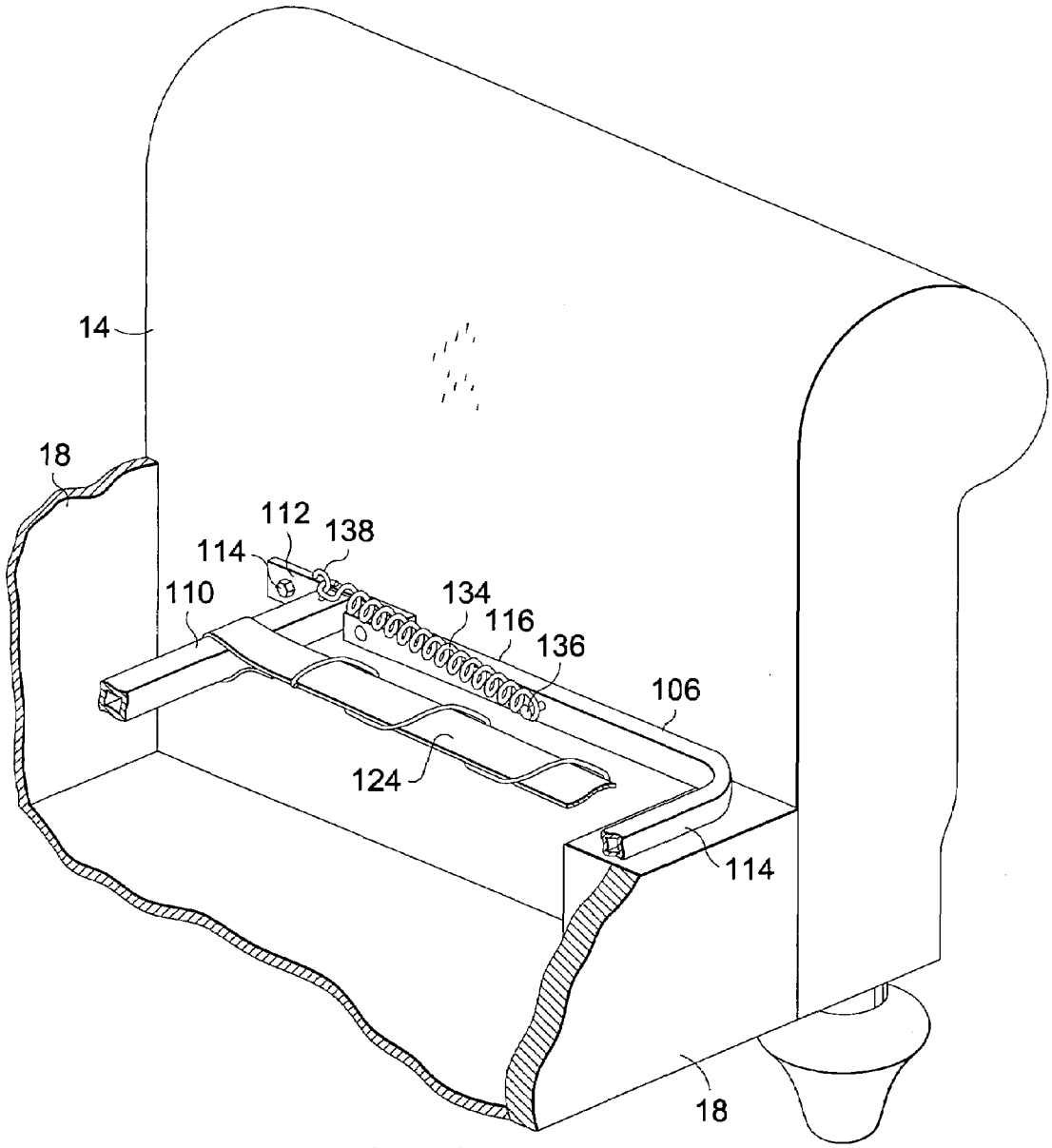
FIG. 10 is a partial enlarged view of portions of the spring deck and mounting rod of the additional embodiment of FIG. 9.

Referring now to FIGS. 9 and 10, an additional embodiment of a spring deck 104 will be discussed. It is understood that the additional embodiment of the spring deck 104 works with the components of the sofa 10 described above. The spring deck 104 includes a frame 106 and a support surface 108 and a mounting rod 110. The frame is mounted to the sofa 10 by the mounting rod 110. The mounting rod 110 has a plate 112 attached to each end. The plates 112 contain a plurality of apertures 114, shown as connections, used to couple the rod 110 to the sofa arms 14 and the frame 106 to the rod 110. The mounting rod 110 is coupled to the sofa arms 14 at a position intermediate the front and back of the sofa.

The frame 106 is shaped as shown and is constructed from steel tubing. It will be appreciated by one of ordinary skill in the art that any suitable material may be used. The frame 106 includes a front portion 114 and a pair of side portions 116. The front 114 and side portions 116 may be integral or separate pieces fastened together. The side portions 116 extend from the mounting rod 110 to the front 18 of the sofa 10. Each side portion 116 contains an aperture 118 that receives a bolt 120 to attach the frame 106 to the plate 112 of the mounting rod 110.

The spring deck 104 also includes a cover 122 and a plurality of webbings 124. The webbings 124 extend from the mounting rod 110 to the front portion 114 of the frame 106 and are attached thereto. It will be appreciated by one of ordinary skill in the art that any attachment method may be used. The webbings 124 of the spring deck 104 further include sinuous wires 126 that encircle each webbing 124 in a serpentine manner. The webbings 124 are interconnected by a number of support rods 128. The support rods 128 extend between the sides portions 116 of the frame 106 and attach to the webbings 124 via couplers 130. The sinuous wires 126 are connected to the webbings 124 via slits 132. The rods 128 together with the couplers 130 serve to align the webbings 124 of the spring deck 104 to provide the smooth, uniform support surface 108.

The spring deck 108 also contains a spring 134 attached to the frame 106 and the mounting rod 110. The spring 134 is attached by protrusions 136, 138. The spring 134 facilitates movement of the spring deck 108 from the closed position to the open position.

Referring again to FIGS. 9 an 10, the operation of the spring deck 104 will be discussed. In order to move the spring deck 104 from the closed position to the open position, the user simply lifts upwardly on the front 114 of the frame 106. The upward lifting by the user causes the front portion 114 of the frame 106 to rotate about the rotatable connection between the frame 106 and the mounting rod 110. Thus, the rotatable connection between the mounting rod 110 and the frame 106 allows the spring deck 104 to be lifted without interfering with the back 16.

The present invention has been described in relation to particular embodiments, which are intended in all respects to be illustrative rather than restrictive. Alternative embodiments will become apparent to those skilled in the art to which the present invention pertains without departing from its scope.

From the foregoing, it will be seen that this invention is one well adapted to attain all the ends and objects set forth above, together with other advantages, which are obvious and inherent to the system and method. It will be understood that certain features and sub-combinations are of utility and may be employed without reference to other features and sub-combinations. This is contemplated and within the scope of the claims.

What is claimed is:

1. A sofa, comprising:

a sofa frame having a back, a front, and a pair of opposed arms;

a deck rotatably coupled between the pair of opposed arms at a position intermediate the front and the back, the deck including a frame, a rod extending between a pair of opposed arms and disposed in relation to the frame intermediate the front and the back of the sofa frame, and a support surface;

wherein the frame of the deck includes a rear portion extending towards the back of the sofa frame and a front portion pivotally coupled with the rear portion at a position intermediate the front and the back of the sofa frame for movement of the deck between a first position in which the front portion of the deck frame extends towards the front of the sofa frame and the deck is generally horizontal for supporting a user and a second position in which the deck is rotated upwardly from the first position to expose a cavity of the sofa.

2. The sofa of claim 1, wherein the support surface extends from the rod to a front portion of the frame of the deck.

3. The sofa of claim 2, wherein the support surface has a plurality of webbings.

4. The sofa of claim 3, wherein the webbings have wires that support the webbings.

5. The sofa of claim 4, wherein the wires encircle the webbings.

6. The sofa of claim 5, wherein the wires are sinuous.

* * * * *